US008922316B2

(12) United States Patent
Lu

(10) Patent No.: US 8,922,316 B2
(45) Date of Patent: Dec. 30, 2014

(54) DEVICE AND MANUFACTURING METHOD FOR A DIRECT CURRENT FILTER INDUCTOR

(75) Inventor: Zengyi Lu, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 13/592,579

(22) Filed: Aug. 23, 2012

(65) Prior Publication Data

US 2013/0162384 A1 Jun. 27, 2013

(30) Foreign Application Priority Data

Dec. 23, 2011 (CN) ..... 2011 1 0440340

(51) Int. Cl.

| | |
|---|---|
| ***H01F 17/06*** | (2006.01) |
| ***H01F 27/24*** | (2006.01) |
| ***H01F 17/04*** | (2006.01) |
| ***H01F 17/00*** | (2006.01) |
| ***H01F 3/14*** | (2006.01) |

(52) U.S. Cl.

CPC ..... *H01F 3/14* (2013.01)
USPC ..... 336/178; 336/212; 336/221; 323/355

(58) Field of Classification Search

CPC ..... H01F 3/00; H01F 5/00; H01F 19/00; H01F 27/00; H01F 3/14; H01F 38/023; H01F 27/24; H01F 27/385; H02M 1/126; H02M 1/40; H02M 3/00; H02M 1/26
USPC ..... 336/178, 180, 186, 212, 214, 221; 307/105, 108, 147; 323/290, 305, 355, 323/362

See application file for complete search history.

(56) References Cited

U.S. PATENT DOCUMENTS

| | | | | |
|---|---|---|---|---|
| 3,243,745 | A * | 3/1966 | Glover et al. | 336/83 |
| 4,603,314 | A * | 7/1986 | Fukunaga et al. | 336/65 |
| 5,481,238 | A * | 1/1996 | Carsten et al. | 336/214 |
| 6,002,319 | A * | 12/1999 | Honma | 336/73 |
| 6,642,828 | B2 * | 11/2003 | Kvarnsjo et al. | 336/178 |
| 6,856,230 | B2 * | 2/2005 | Lu | 336/212 |
| 2011/0032683 | A1 * | 2/2011 | Li et al. | 361/760 |

FOREIGN PATENT DOCUMENTS

TW 201106145 A1 2/2011

* cited by examiner

*Primary Examiner* — Elvin G Enad
*Assistant Examiner* — Joselito Baisa
(74) *Attorney, Agent, or Firm* — Tim Tingkang Xia, Esq.; Morris, Manning & Martin, LLP

(57) ABSTRACT

The device and manufacturing method for a Direct Current (DC) filter inductor are disclosed. The device comprises a magnetic core, at least one first winding and at least one second winding. The magnetic core has at least one air gap. The first winding and the second winding are connected to each other in parallel that having a mutual inductance, and are wrapped around the magnetic core respectively. A difference between a first inductance of the first winding and the mutual inductance is smaller than a difference between a second inductance of the second winding and the mutual inductance. A Direct Current (DC) resistance of the first winding is larger than a DC resistance of the second winding. The first winding is closer to the air gap compared to the second winding.

37 Claims, 13 Drawing Sheets

DEVICE AND MANUFACTURING METHOD FOR A DIRECT CURRENT FILTER INDUCTOR

FIELD OF THE INVENTION

The present disclosure generally relates to an inductor device, and more specifically to the device and manufacturing method for a Direct Current (DC) filter inductor.

BACKGROUND

In a switch-mode DC to DC (DC-DC) converter, a switching frequency of a switch is higher than 10 KHz, so a current of the filter inductor has two components. One is the DC current and the other is high frequency AC ripple current. In a switch-mode AC to DC (AC-DC) converter (i.e. an active power factor correction (PFC) circuit), a current of the filter inductor also contains two components. One is the high frequency AC ripple current. The other one is the AC current with a low frequency below 400 Hz, and it is considered as the DC current compared to the switching frequency. Therefore, an operational inductor that contains both DC current component and high frequency AC ripple current is called a DC filter inductor.

The DC current component of the DC filter inductor forms a massive magnetic potential in the magnetic circuit. In order to avoid the saturation of the magnetic core as the magnetic core plays a vital role in raising the level of magnetic flux. It is required to increase/add the gap resistance (i.e. air gap) to the magnetic core, which reduces DC flux of the flux path, especially to those magnetic cores that are made of materials such as a ferrite, a silicon steel and an amorphous ferromagnet. As shown in FIG. 1 of an exemplary conventional embodiment indicating a single-phase inductor, a winding L is wrapped around middle arms of an EE type core which have air gaps. Furthermore, for a three-phase inductor, three windings are wrapped around three core arms respectively and each core arm has an air gap.

As current flows through the winding L, magnetic fields will be generated not only in the core and the air gap but also inside the winding L. The magnetic field of the winding L is composed of an air-gap magnetic field strength $H_a$ and a bypassing magnetic field strength $H_b$. So a high frequency AC current flowing through the winding causes an AC winding loss which contains an air-gap magnetic field strength loss and a bypassing magnetic field strength loss. Using Litz wire as the winding L is one of the known skills for reducing the air-gap magnetic field strength loss, and is designed to reduce the skin effect loss and proximity effect loss. However, the bypassing magnetic field strength loss can not be reduced by the replacement the Litz wire and the bypassing magnetic field strength $H_b$ is irrelevant to either shape or structure of the winding L. As shown in FIG. 1, the bypassing magnetic field strength $H_b$ is in a linear relation of a distance x between the winding L and the air gap. In other words, Litz wire type winding remains AC winding loss.

In general, winding loss may cause the winding temperature rising. As shown in FIG. 2, a heat dissipating metal 200 is needed and is disposed inside the winding, as the winding loss generates undesirable heat. However, due to the existence of the bypassing magnetic field strength $H_b$, an eddy current is induced on the heat dissipating metal 200 resulting in additional winding loss.

Further, FIG. 3 shows an exemplary conventional embodiment indicating an UU type inductor that has two windings $W_1$, $W_2$ and two air gaps $g_1$, $g_2$. The AC magnetic potential is formed on the magnetic circuit as AC current flows through the winding $W_1$, $W_2$, and is mostly imposed on sides of the air gaps $g_1$, $g_2$. As shown in FIG. 3, when the air gaps $g_1$, $g_2$ are not covered by the winding $W_1$, $W_2$, the imposed magnetic flux of the air gaps $g_1$, $g_2$ will form magnetic field strengths on the edge of the inductor, which brings the near-field magnetic interference.

Therefore, there is one of the needs for a new inductor device which minimizes winding losses.

Some Exemplary Embodiments

These and other needs are addressed by various embodiments of the disclosure, wherein an approach is provided for minimizing winding losses and near-field magnetic interference (e.g., Alternating Current (AC) winding loss) of a Direct Current (DC) filter inductor device and an associated manufacturing method by reducing the bypassing magnetic field strength $H_b$ inside the winding.

According to one aspect of an embodiment of the disclosure, a device for a direct current filter inductor comprises a magnetic core having at least one air gap, and at least one first winding and at least one second winding, which are connected to each other in parallel that having a mutual inductance, and are wrapped around the magnetic core respectively, wherein a difference between a first inductance of the first winding and the mutual inductance is smaller than a difference between a second inductance of the second winding and the mutual inductance; a Direct Current (DC) resistance of the first winding is larger than a DC resistance of the second winding; and the first winding is closer to the air gap compared to the second winding.

In an embodiment, the first winding has a wire diameter that is smaller than a wire diameter of the second winding.

In an embodiment, the first winding and the second winding are wrapped around the magnetic core separately. The first winding is fully or partially wrapped around the air gap.

In an embodiment, the device further comprises an inductance element connected to the first winding and the second winding in parallel or in series.

In an embodiment, the difference between the first inductance and the mutual inductance is smaller than ⅓ of the difference between the second inductance and the mutual inductance.

In an embodiment, the first inductance is equal to the mutual inductance.

In an embodiment, the device further comprises an inductance element connected to the first winding in series when the first inductance is smaller than the mutual inductance, wherein the first winding and the inductance element are connected to the second winding in parallel, and a difference between the summation of the first inductance and an inductance of the inductance element and the mutual inductance is smaller than the difference between the second inductance and the mutual inductance. The difference between the summation of the first inductance of the inductance element and the mutual inductance is smaller than ⅓ of the difference between the second inductance and the mutual inductance.

In an embodiment, wherein a DC resistance summation of the first winding and the inductance element is larger than the DC resistance of the second winding.

In an embodiment, the magnetic core is an EE type core that comprises a middle arm and two side arms, wherein the middle arm has the air gap, the first winding is wrapped around the middle arm, and the second winding is wrapped around the first winding.

In an embodiment, the magnetic core is an UU type core formed by two oppositely U-shaped core, and each U-shaped core comprises a longitudinal arm and two latitudinal side arms that are extended orthogonally from two ends of the longitudinal arm respectively. The latitudinal side arms of the U-shaped core are abutted adjacent to the corresponding latitudinal side arms of the other U-shaped core, thereby forming the two air gaps in between, and two first windings are wrapped around the corresponding air gaps and two second windings are wrapped around the corresponding longitudinal arms.

In an embodiment, the magnetic core is an EI type core formed by coupling a substantially E-shaped core to a magnetic bar, and the E-shaped core comprises three longitudinal arms and a latitudinal arm, each longitudinal arms has a first end that is extended orthogonally from the latitudinal arm, and second ends of the longitudinal arms are disposed adjacent to the magnetic bar with a corresponding air gap. Three first windings are wrapped around the corresponding longitudinal arms, and three second windings are wrapped around the corresponding longitudinal arms In an embodiment, the device further comprises a first current sensing element connected to the first winding in series, and is configured to sense current flowing through the first winding.

In an embodiment, the device further comprises a second current sensing element connected to the second winding in series, and is configured to sense current flowing through the second winding.

In an embodiment, the first winding has a first wire or a multi-stand wire, and the second winding has a second wire, a copper foil winding or a PCB winding, wherein a wire diameter of the first wire is smaller than a wire diameter of the second wire.

According to another aspect of an embodiment of the disclosure, a device for a direct current filter inductor comprises a magnetic core, at least one first winding and at least one second winding. The first winding has a first end and a second end. The second winding has a first end and a second end. The first end and the second end of the first winding are connected to the first end and the second end of the second winding, respectively. The first winding and the second winding has a mutual inductance, and a difference between a first inductance of the first winding and the mutual inductance is smaller than a difference between a second inductance of the second winding and the mutual inductance. A DC resistance of the first winding is larger than a DC resistance of the second winding.

In an embodiment, the first and the second windings are separately wrapped around the magnetic core or wrapped around the magnetic core together.

In an embodiment, the device further comprises an inductance element connected to the first winding and the second winding in parallel or in series.

In an embodiment, the difference between the first inductance and the mutual inductance is smaller than ⅓ of the difference between the second inductance and the mutual inductance.

In an embodiment, the first inductance is equal to the mutual inductance.

In an embodiment, the device further comprises an inductance element connected to the first winding in series when the first inductance is smaller than the mutual inductance, wherein the first winding and the inductance element are connected to the second winding in parallel, and a difference between the summation of the first inductance and an inductance of the inductance element and the mutual inductance is smaller than the difference between the second inductance and the mutual inductance. The difference between the summation of the first inductance and the inductance of the inductance element and the mutual inductance is smaller than ⅓ of the difference between the second inductance and the mutual inductance.

In an embodiment, a DC resistance summation of the first winding and the inductance element is larger than the DC resistance of the second winding.

In an embodiment, the device further comprises a first current sensing element connected to the first winding in series, and is configured to sense current flowing through the first winding.

In an embodiment, the device further comprises a second current sensing element connected to the second winding in series, and is configured to sense current flowing through the second winding.

In an embodiment, the first winding has a first wire or a multi-stand wire, and the second winding has a second wire, a copper foil winding or a PCB winding, wherein a wire diameter of the first wire is smaller than a wire diameter of the second wire.

According to yet other aspect of another embodiment of the disclosure, a manufacturing method for a direct current filter inductor comprises step of providing a magnetic core; wrapping at least one first winding and at least one second winding around the magnetic, wherein a mutual inductance formed by the first and the second winding; configuring a difference between a first inductance of the first winding and the mutual inductance being smaller than a difference between a second inductance of the second winding and the mutual inductance, and a DC resistance of the first winding is larger than a DC resistance of the second winding; and coupling the first winding and the second first winding in parallel.

In an embodiment, the magnetic core has at least one air gap, and the first winding is closer to the air gap compared to the second winding.

In an embodiment, the method further comprises act of wrapping the first winding is fully or partially around the air gap.

In an embodiment, a first end and a second end of the first winding are connected to a first end and a second end of the second winding, respectively.

In an embodiment, the mentioned step of wrapping the first winding and the second winding around the magnetic core further comprises step of wrapping the first and the second windings separately or together around the magnetic core.

In an embodiment, the method further comprises acts of providing an inductance element connected to the first winding and the second winding in series or in parallel.

In an embodiment, the steps of configuring the difference between the first inductance of the first winding and the mutual inductance being smaller than the difference between the second inductance of the second winding and the mutual inductance further comprises step of configuring the difference between the first inductance and the mutual inductance is smaller than ⅓ of the difference between the second inductance and the mutual inductance.

In an embodiment, the method further comprises step of configuring the first inductance being equal to the mutual inductance.

In an embodiment, the method further comprises step of providing an inductance element connected to the first winding when the first inductance is smaller than the mutual inductance, wherein the first winding and the inductance element are connected to the second winding in parallel, and a difference between the summation of the first inductance and an inductance of the inductance element and the mutual inductance is smaller than the difference between the second inductance and the mutual inductance.

In an embodiment, the difference between the summation of the first inductance and the inductance of the inductance element and the mutual inductance is smaller than ⅓ of the difference between the second inductance and the mutual inductance.

In an embodiment, the method further comprises step of configuring a DC resistance summation of the first winding and the inductance element being larger than a DC resistance of the second winding.

In an embodiment, the method further comprises step of providing a first current sensing element connected to the first winding in series.

In an embodiment, the method further comprises step of providing a second current sensing element connected to the second winding in series.

Accordingly, the embodiments of the present disclosure separating the AC and DC current components, thereby two independent inductance windings connected in parallel are wrapped around a same arm of the magnetic core, which achieves not only reducing AC winding loss and easier for current sensing, also improves the flux distributions around the air gap for reducing the magnetic interference.

Still other aspects, features and advantages of the disclosure are readily apparent from the following detailed description, simply by illustrating a number of particular embodiments and implementations, including the best mode contemplated for carrying out the disclosure. The disclosure is also capable of other and different embodiments, and its several details can be modified in various obvious respects, all without departing from the spirit and scope of the disclosure. Accordingly, the drawings and description are to be regarded as illustrative, and not as restrictive.

BRIEF DESCRIPTION OF THE DRAWINGS

The disclosure is illustrated by way of example, and not by way of limitation, in the figures of the accompanying drawings in which like reference numerals refer to similar elements and in which.

DESCRIPTION OF THE PREFERRED EMBODIMENTS

Inductor devices with minimized winding losses are disclosed. In the following description, for purposes of explanation, numerous specific details are set forth in order to provide a thorough understanding of the embodiment of the disclosure. It is apparent, however, to one skilled in the art that the present disclosure may be practiced without these specific details or with an equivalent arrangement.

Figure 4:
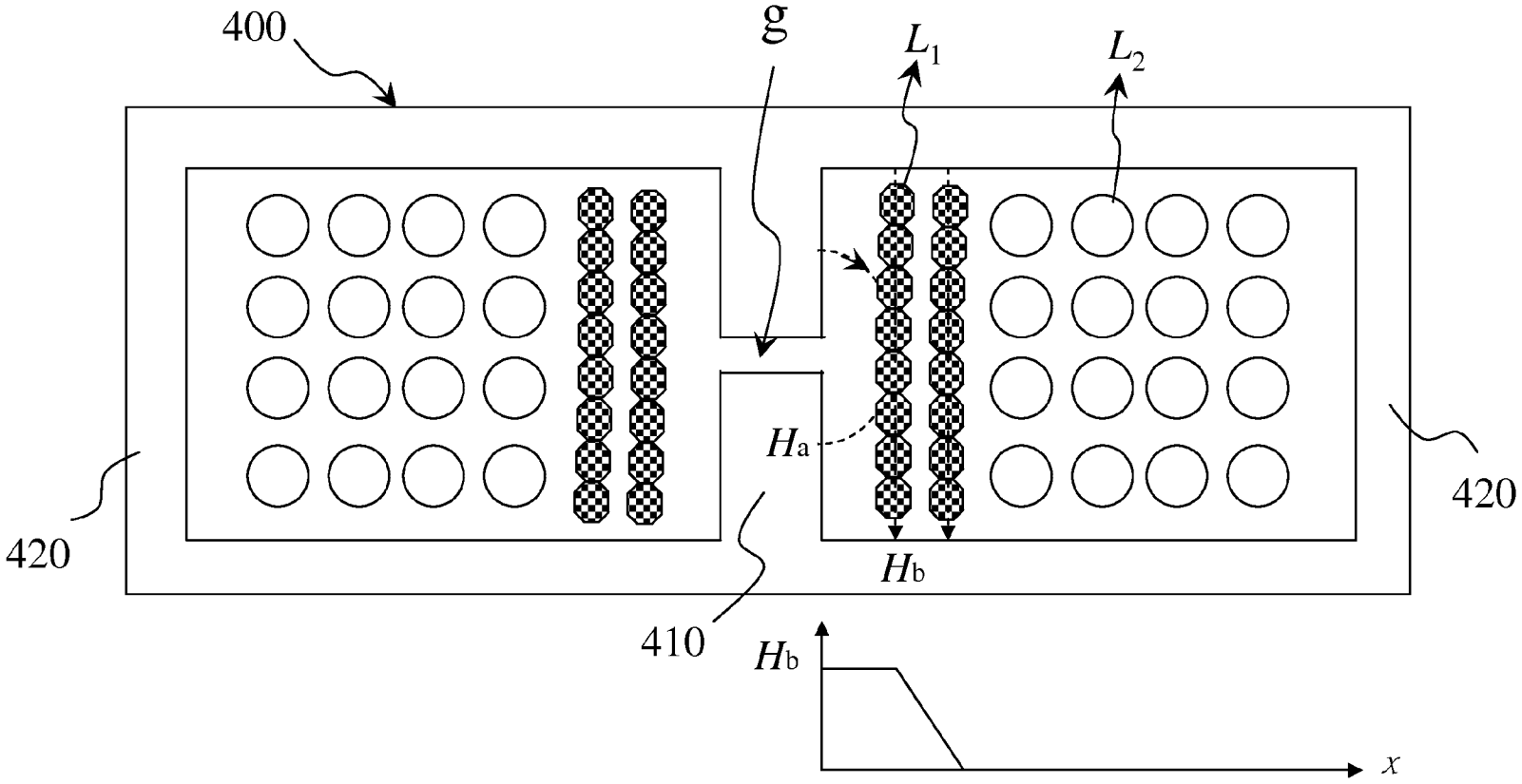
FIG. 4 is an exemplary diagram of an inductor device, in accordance with an embodiment of the present disclosure.

With reference to FIG. 4, FIG. 4 is an exemplary diagram of an inductor device in accordance with an embodiment of the present disclosure. For the purposes of illustrations, the winding loss of an inductor device is minimized by using a first winding L1 and a second winding L2 connected in parallel.

The inductor device, according to one embodiment as shown in FIG. 4, has a magnetic core 400 along with the first winding L1 and second winding L2. The magnetic core 400 has at least one air gap g. The first winding L1 and the second winding L2 are wrapped around the magnetic core 400 respectively, and the first winding L1 is closer to the air gap g compared to the second winding L2, i.e., the distance between the air gap g and the first winding L1 is less than the distance between the air gap g and the second winding L2.

In this embodiment, as shown in FIG. 4, the magnetic core 400 may be an EE type magnetic core that comprises a middle arm 410 and two side arms 420. The middle arm 410 has the air gap g and forms two winding areas with two side arms 420. The first winding L1 is wrapped around the middle arm 410 through the winding areas. The second winding L2 is wrapped around the first winding L1 through the winding areas.

According to the distribution characteristic of magnetic field, as the first winding L1 is closer to the air gap g, the magnetic field of the first winding L1 has an internal flux, a flux of an air-gap magnetic field strength $H_a$ and a flux of the middle arm 410. As the second winding L2 is wrapped around the first winding L1 and away from the air gap g, the magnetic field of the second winding L2 has all the flux of the first winding L1 and an additional internal flux of the second winding L2. In other words, an inductance of the second winding L2 is larger than an inductance of the first winding L1.

Since the first winding L1 and second winding L2 are wrapped around the same middle arm 410, a mutual inductance M is created. In addition, The mutual inductance M can be determined by measuring the inductance of winding in the following relation:

$$M = \frac{L_s - L_d}{4}; \tag{1}$$

wherein $L_s$ is the inductance yielded by series aiding between the first winding L1 and the second winding L2, and $L_d$ is the inductance yielded by series opposing between the first winding L1 and the second winding L2.

Figure 5:
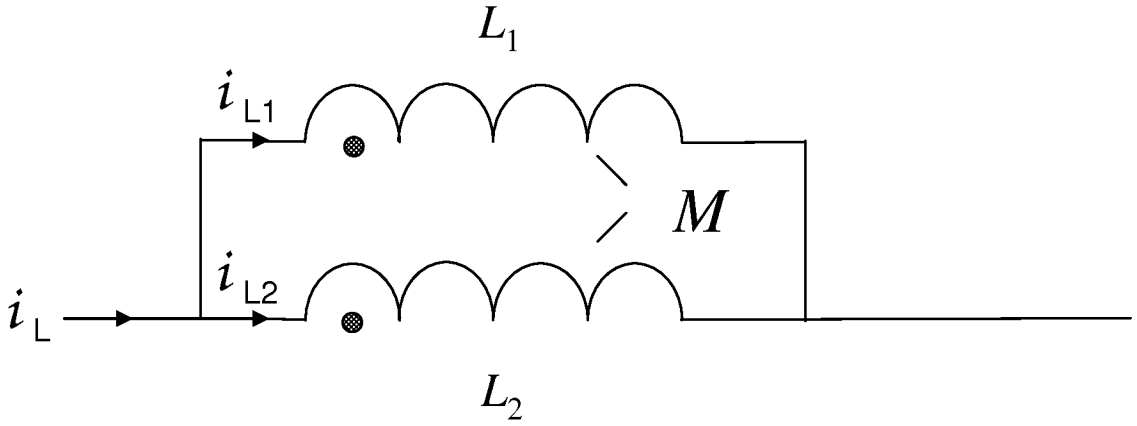
FIG. 5 is an equivalent circuit diagram of the inductor device of FIG. 4.

An equivalent circuit diagram of the inductor device is shown in FIG. 5 in accordance the embodiment of the present disclosure as shown in FIG. 4. The DC inductor current $i_L$ has a DC current component $I_{dc}$ and AC current component $I_{ac}$. Further, the DC inductor current $i_L$ is divided into a first current $i_{L1}$ and a second current $i_{L2}$ corresponding to the first winding L1 and the second winding L2 that is parallel connected.

The DC current components of two parallel connected windings L1, L2 comprises a first DC current component $I_{dc1}$ and a second DC current component $I_{dc2}$, and are determined based on the DC resistance of the windings L1, L2. The first DC current component $I_{dc1}$ and the second DC current component $I_{dc2}$ have a following relation of:

$$I_{dc1} = \frac{R_2}{R_1 + R_2} I_{dc};$$

$$I_{dc2} = \frac{R_1}{R_1 + R_2} I_{dc};$$

wherein $R_1$ is a DC resistance of the first winding L1, and $R_2$ is a DC resistance of the second winding L2.

The AC current components of two parallel connected windings L1, L2 comprises a first AC current component $I_{ac1}$ and a second AC current component $I_{ac2}$, and have a following relation of:

$$I_{ac1} = \frac{L_2 - M}{L_1 + L_2 - 2M} I_{ac}; \quad (2)$$

$$I_{ac2} = \frac{L_1 - M}{L_1 + L_2 - 2M} I_{ac}; \quad (3)$$

wherein $L_1$ and $L_2$ indicates the inductances of the first winding L1 and the second winding L2.

Figure 6:
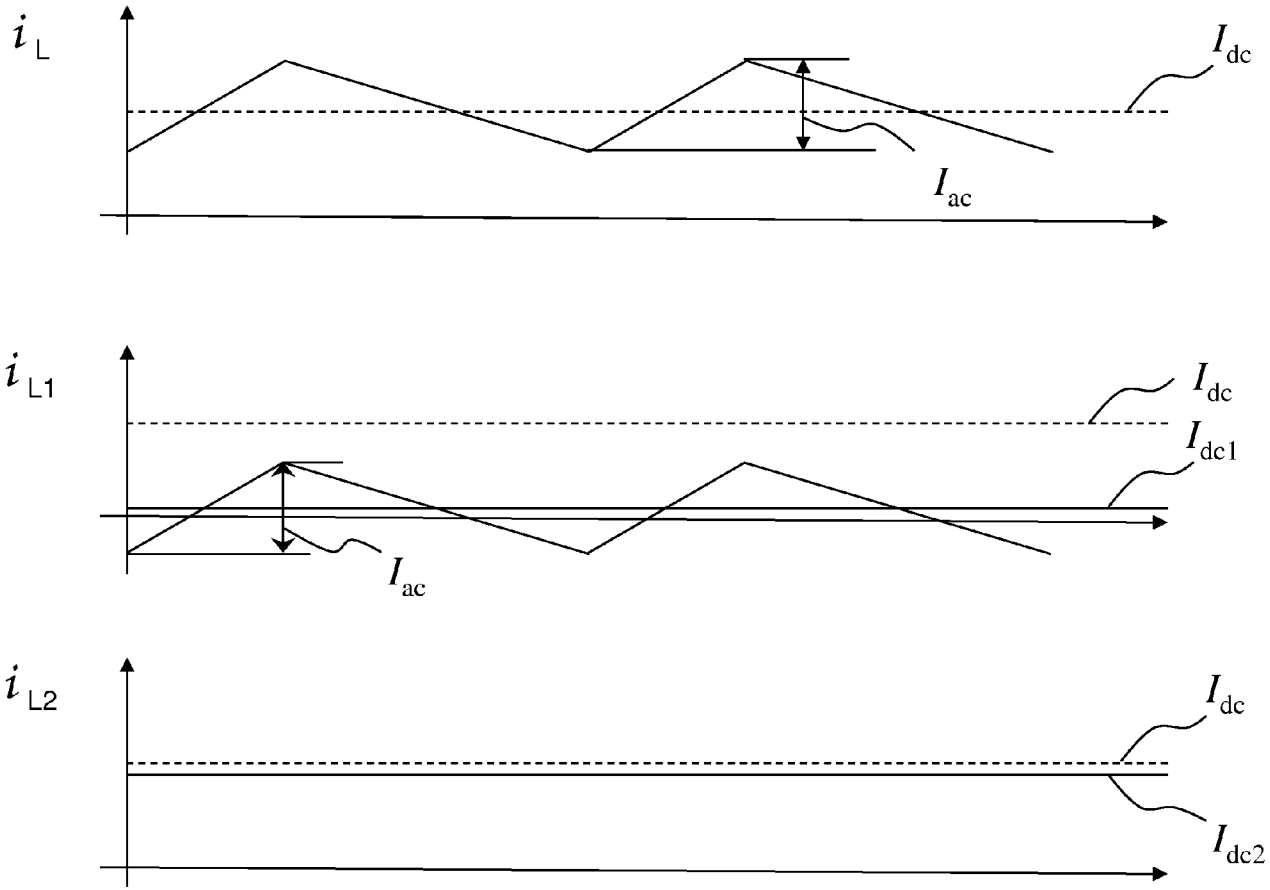
FIG. 6 is an current waveform in accordance with an embodiment of the present disclosure.

With reference to FIG. 6, FIG. 6 illustrates current waveforms of the FIG. 5 in accordance with the embodiment of the present disclosure. When the first inductance L1 equals the mutual inductance M, all of the AC current component $I_{ac}$ flows through the first winding L1 (i.e. $I_{ac1}=I_{ac}$, $I_{ac2}=0$). In this example, the air-gap magnetic field strength $H_a$, as shown in FIG. 4, occurs only in a region of the air gap g and the first winding L1. The bypassing magnetic field strength $H_b$ is eliminated as no AC current component $I_{ac2}$ in the second winding L2. Therefore, when a heat dissipating element disposed inside the second winding L2, as previous mentioned, will not result in an eddy current that reduces the additional AC winding loss.

In a general circumstances, when the first AC current component $I_{ac1}$ is 3 times larger than the second AC current component $I_{ac2}$, it can be interpreted as the first AC current component $I_{ac1}$ is great larger than the second AC current component $I_{ac2}$. Accordingly, the AC current component $I_{ac}$ can almost be interpreted as flows through the first winding L1, when the difference between the first inductance and the mutual inductance M is smaller than ⅓ of the difference between the second inductance and the mutual inductance M. as such, the ratio of the first AC current component $I_{ac1}$ and the second AC current component $I_{ac2}$ can be determined using the following relationship:

$$\left|\frac{i_{ac2}}{i_{ac1}}\right| = \left|\frac{L_1 - M}{L_2 - M}\right| < \frac{1}{3}. \quad (4)$$

Accordingly, when the first winding L1 is wrapped near the air gap g, and has flowed most AC current component $I_{ac1}$, the air-gap magnetic field strength $H_a$ and the bypassing magnetic field strength $H_b$ formed by the AC magnetic potential can be desirable controlled near the air gap g. However, as the air-gap magnetic field strength $H_a$ and the bypassing magnetic field strength $H_b$ is controlled near the air gap g, their fluxes bring the eddy current loss.

In order to eliminate the eddy current loss by the air-gap magnetic field strength $H_a$ and the bypassing magnetic field strength $H_b$, in one embodiment, the first winding L1 has thin wire with smaller diameter in a parallel-connected configuration. The thin wire maybe a thin conducting wire (i.e., a first wire), and especially for the multi-stand wire or the Litz wire that consisting of many thin wire strands. The wire diameter used in the first winding L1 is considered as the small diameter of the individual stand, and thus reduces the eddy current.

Figure 7:
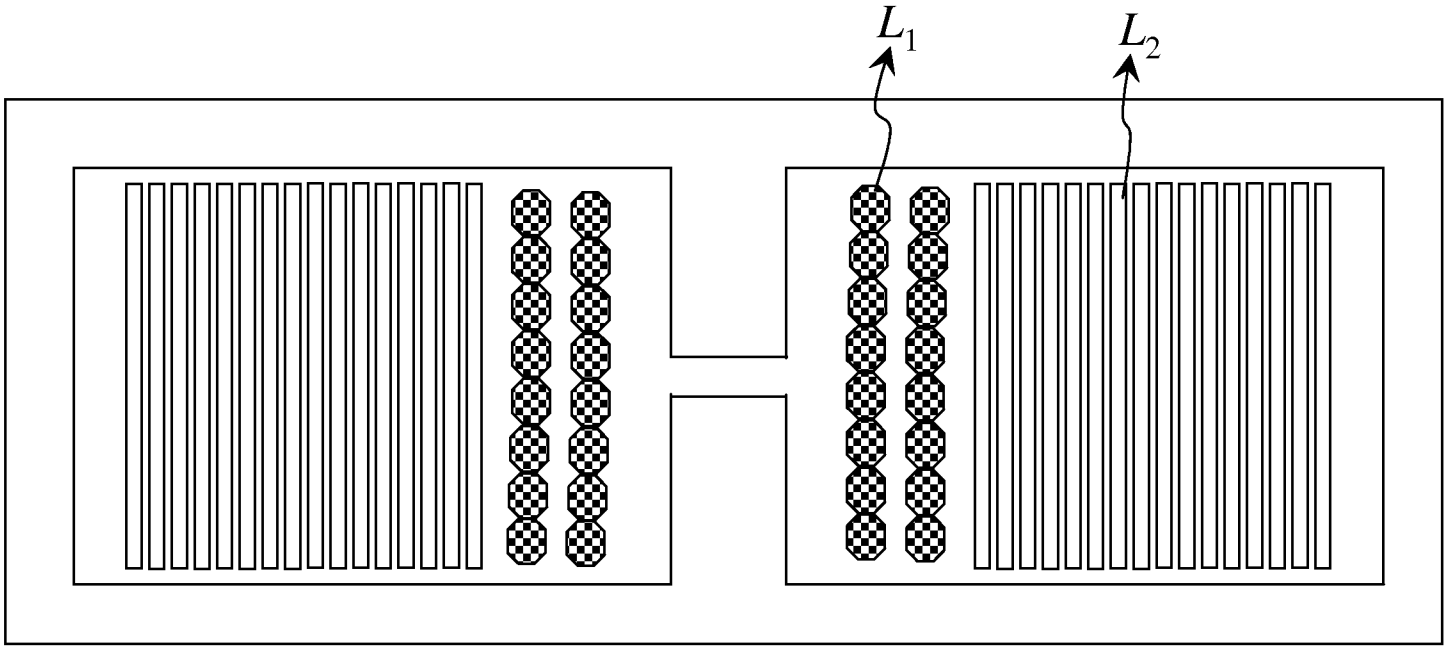
FIG. 7 is an exemplary diagram of an inductor device, in accordance with an embodiment of the present disclosure.

As above-mentioned, when the second winding L2 has no AC current component, it substantially contains the DC current component. In order to increase the amount of the DC current component flowing through the second winding L2, the first DC resistance R1 is configured to be larger than the second DC resistance R2. The DC current loss of the second winding L2 is reduced simultaneously. In some embodiments, the second winding L2 has wires (i.e., a second wire) with a highly filled and thicker wire diameter, or a copper winding or the PCB winding. FIG. 4 shows the thickness of the wires of the second winding L2 compared to the first winding L1, and FIG. 7 shows the copper foil winding used for the second winding L2.

Figure 8:
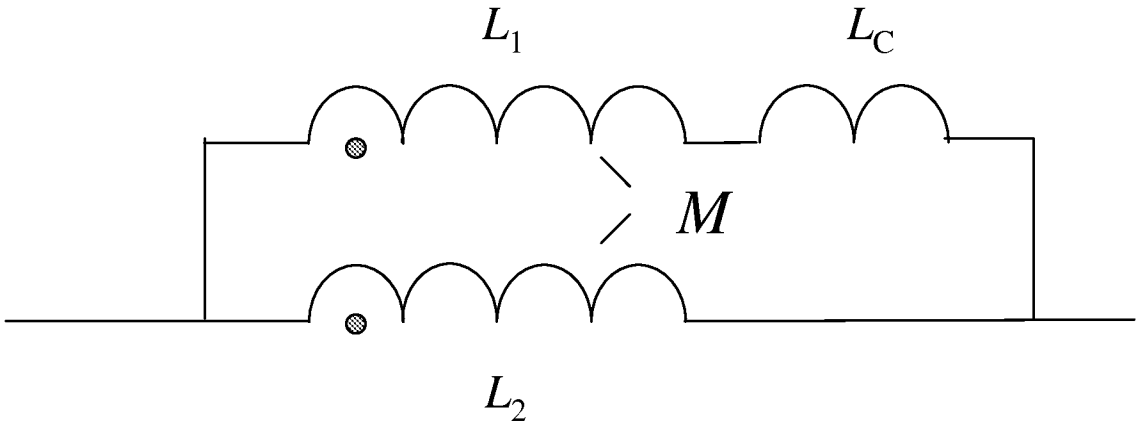
FIG. 8 is an exemplary diagram of an inductor device, in accordance with an embodiment of the present disclosure using additional inductance.

Further, when the inductance of the first winding L1 is smaller than the mutual inductance M (i.e. L1<M), the second AC current component $I_{ac2}$ reverses its flowing direction compared to the direction of the AC current component $I_{ac}$, which increasing the amounts of the first AC current component $I_{ac1}$ and the second AC current component $I_{ac2}$. The AC winding loss increases accordingly. Therefore, in order to avoid the reverse of the AC current component, in another embodiment shown in FIG. 8, the inductor device further incorporates an optional assistance inductance element $L_c$ connected to the first winding L1 in series, which controls the coupling relation of two parallel-connected windings L1, L2 without taking effect to the mutual inductance M. As such, the AC current component Iac flowing through the first winding L1 and the second winding L2 can be determined by the following relationship:

$$i_{ac1} = \frac{L_2 - M}{L_1 + L_c + L_2 - 2M} i_{ac}; \quad (5)$$

$$i_{ac2} = \frac{L_1 + L_c - M}{L_1 + L_c + L_2 - 2M} i_{ac}; \quad (6)$$

wherein $L_c$ indicates the inductance of the assistance inductance element $L_c$.

Moreover, as previously described for ensuring the first AC current component $I_{ac1}$ is 3 times larger than the second AC current component $I_{ac2}$, i.e., it can be interpreted as the first AC current component $I_{ac1}$ is great larger than the second AC current component $I_{ac2}$, configuring the difference between the summation of the first inductance of the first winding L1 and the inductance of the inductance element Lc and the mutual inductance M is smaller than ⅓ of the difference between the second inductance of the second winding L2 and the mutual inductance M. The ratio of the first AC current component $I_{ac1}$ and the second AC current component $I_{ac2}$ can be determined using the following relationship:

$$\left|\frac{i_{ac2}}{i_{ac1}}\right| = \left|\frac{L_1 + L_c - M}{L_2 - M}\right| < \frac{1}{3}; \quad (7)$$

and the AC current component $I_{ac}$ can almost be interpreted as flowing through the first winding L1.

On the other hand, in this embodiment, the DC resistance summation of the first winding L1 and the assistance inductance element $L_c$ is larger than the DC resistance of the second winding L2, which ensures the amount of DC current component on the second winding L2 for reducing the DC loss.

Figure 9:
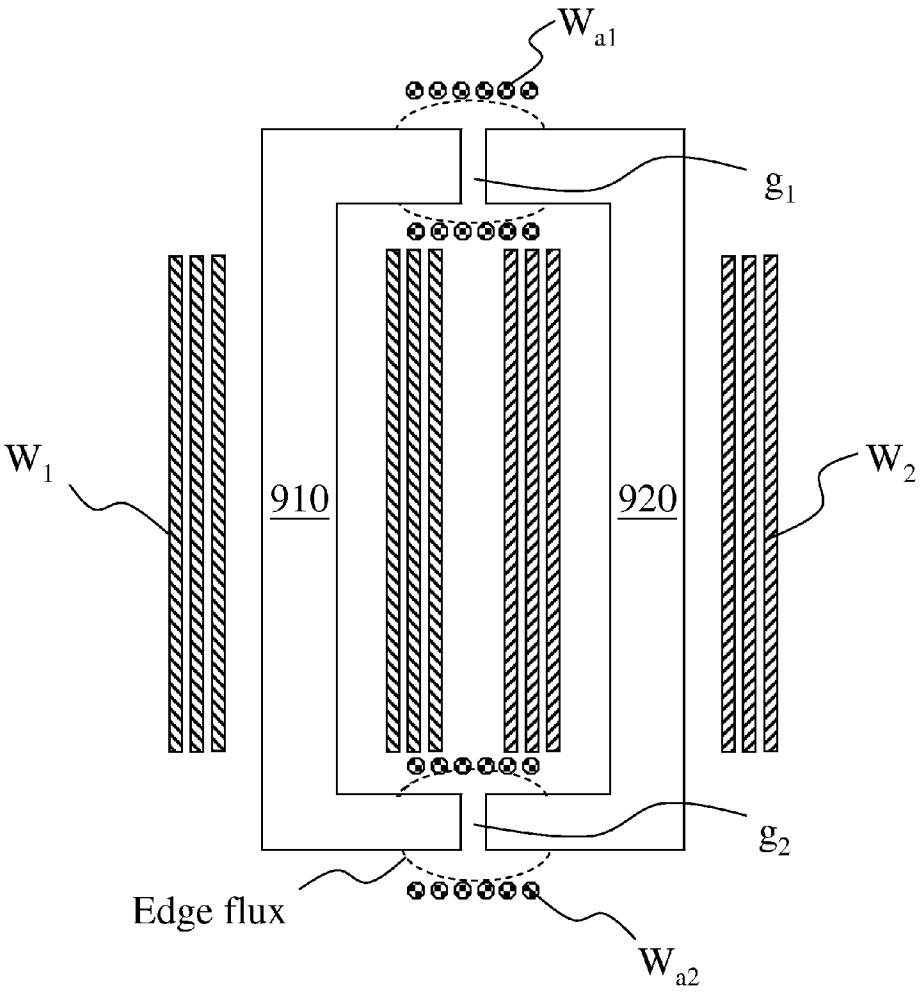
FIG. 9 is an exemplary diagram of an inductor device, in accordance with an embodiment of the present disclosure.

With reference to FIG. 9, FIG. 9 is an exemplary diagram of an inductor device in accordance with an embodiment of the present disclosure. In this embodiment, a magnetic core is a UU type core and is formed by two oppositely U-shaped cores 910, 920. Each of the U-shaped core 910, 920 comprises a longitudinal arm and two latitudinal side arms. The two latitudinal side arms are extended orthogonally from two ends of the longitudinal arm respectively. The side arms of the U-shaped core 910 are abutted adjacent to the corresponding side arms of the other U-shaped core 920, thereby forming two air gaps $g_1$, $g_2$ in between. Two first windings $W_{a1}$, $W_{a2}$ are wrapped around the corresponding side arms surrounding the air gaps $g_1$, $g_2$. Two second windings $W_1$, $W_2$ are wrapped around the corresponding longitudinal arm of the U-shaped core 910, 920. In this manner, the first windings $W_{a1}$, $W_{a2}$ are connected to the second windings $W_1$, $W_2$ in parallel.

Figure 1:
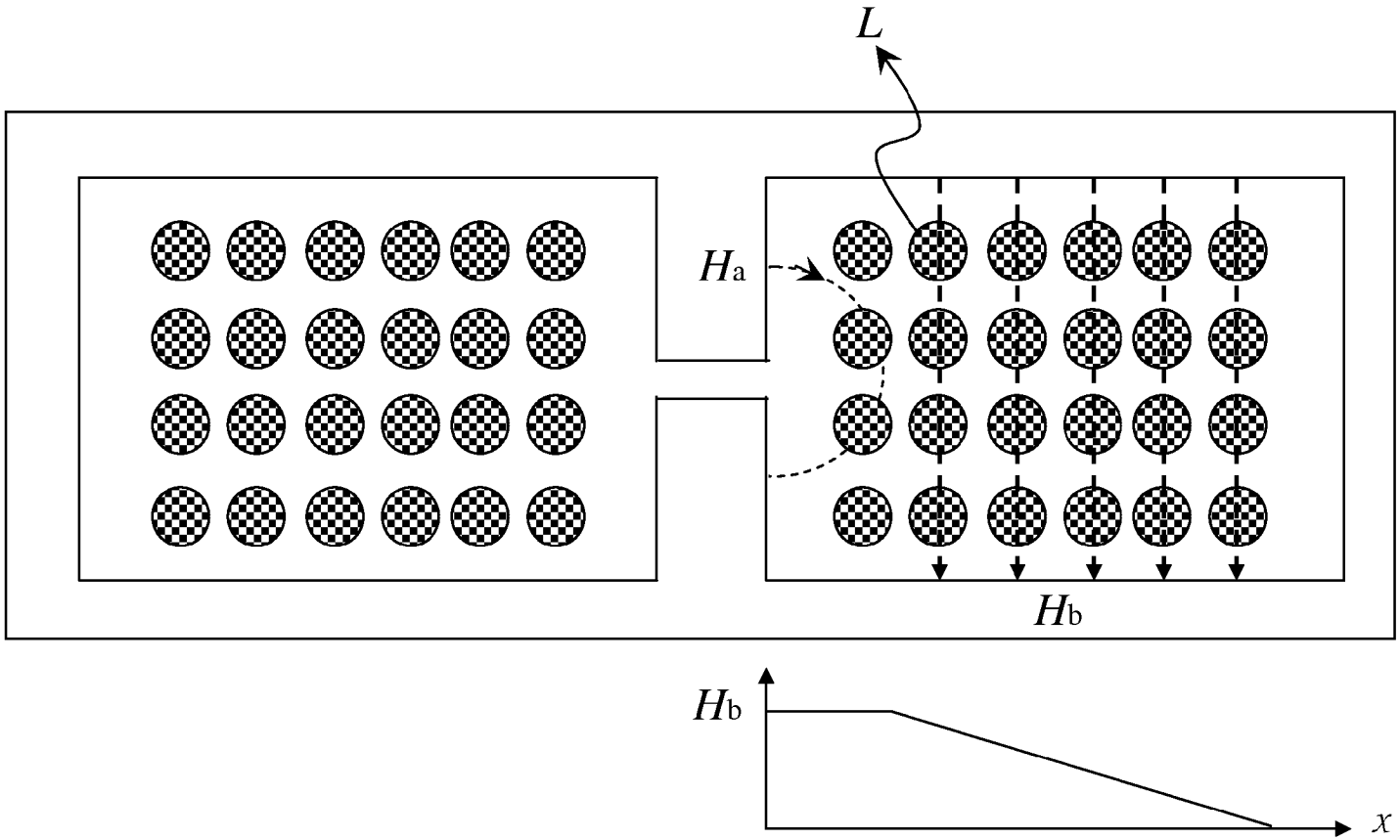
FIG. 1 is an exemplary diagram of a magnetic field distribution of a traditional inductor.
Figure 2:
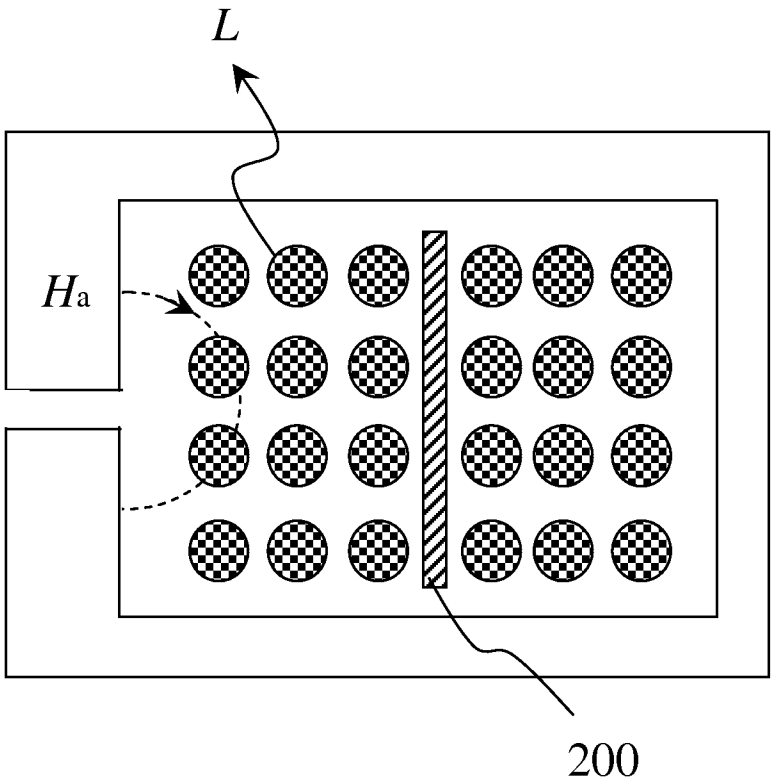
FIG. 2 is an exemplary diagram of a traditional inductor using a heat dissipating metal.
Figure 3:
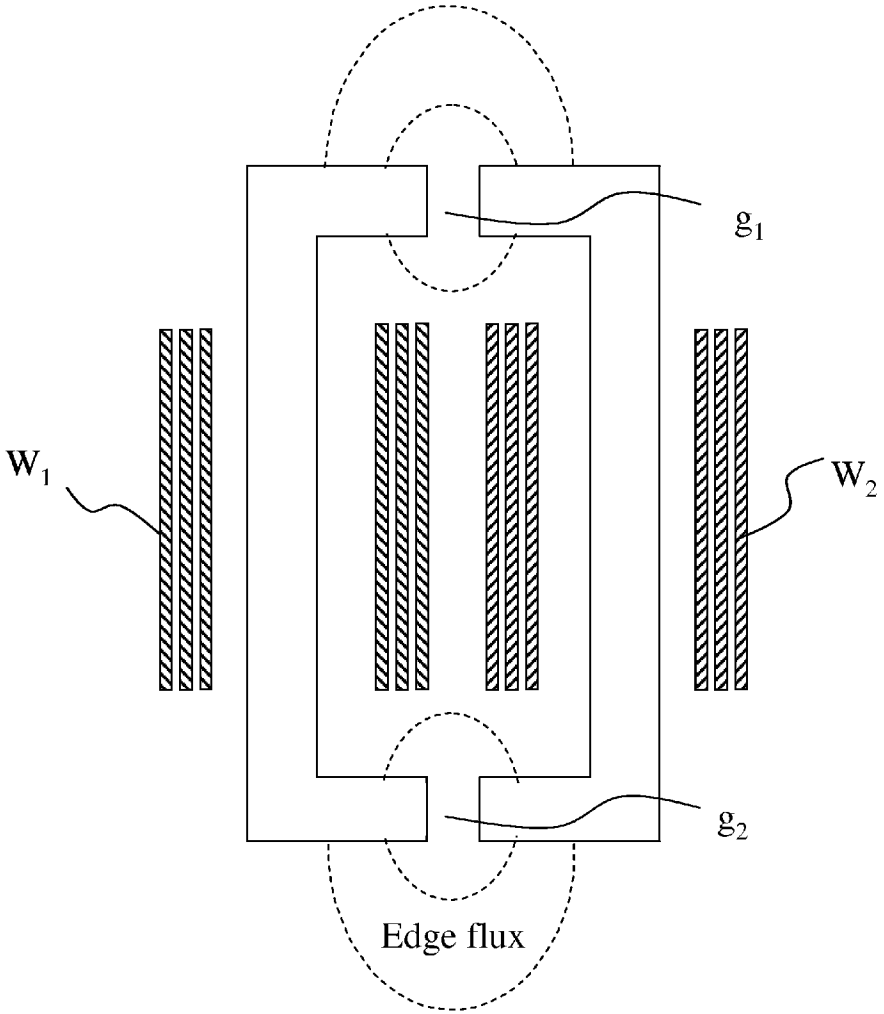
FIG. 3 is an exemplary diagram of a magnetic field distribution of a traditional UU type inductor.

Accordingly, when the first windings $W_{a1}$, $W_{a2}$ and the second windings $W_1$, $W_2$ are parallel-connected and wrapped around the corresponding air gap $g_1$, $g_2$, the AC current component flows through the first windings $W_{a1}$, $W_{a2}$, which is originally flowed through the second windings $W_1$, $W_2$. The AC magnetic flux is controlled near the air gap that avoids the magnetic field dissipation, and reduces the magnetic interference and the winding loss. Therefore, this embodiment solves the problem of magnetic field stray phenomenon, which is described and introduced in the background section of the present disclosure and FIG. 3. It is noted that the coupling relationship and structural concept of the first winding $W_{a1}$, $W_{a2}$ and the second winding $W_1$, $W_2$ are similar to the previous embodiments of FIGS. 4 and 5, thereby omitting the duplicate description.

Figure 10:
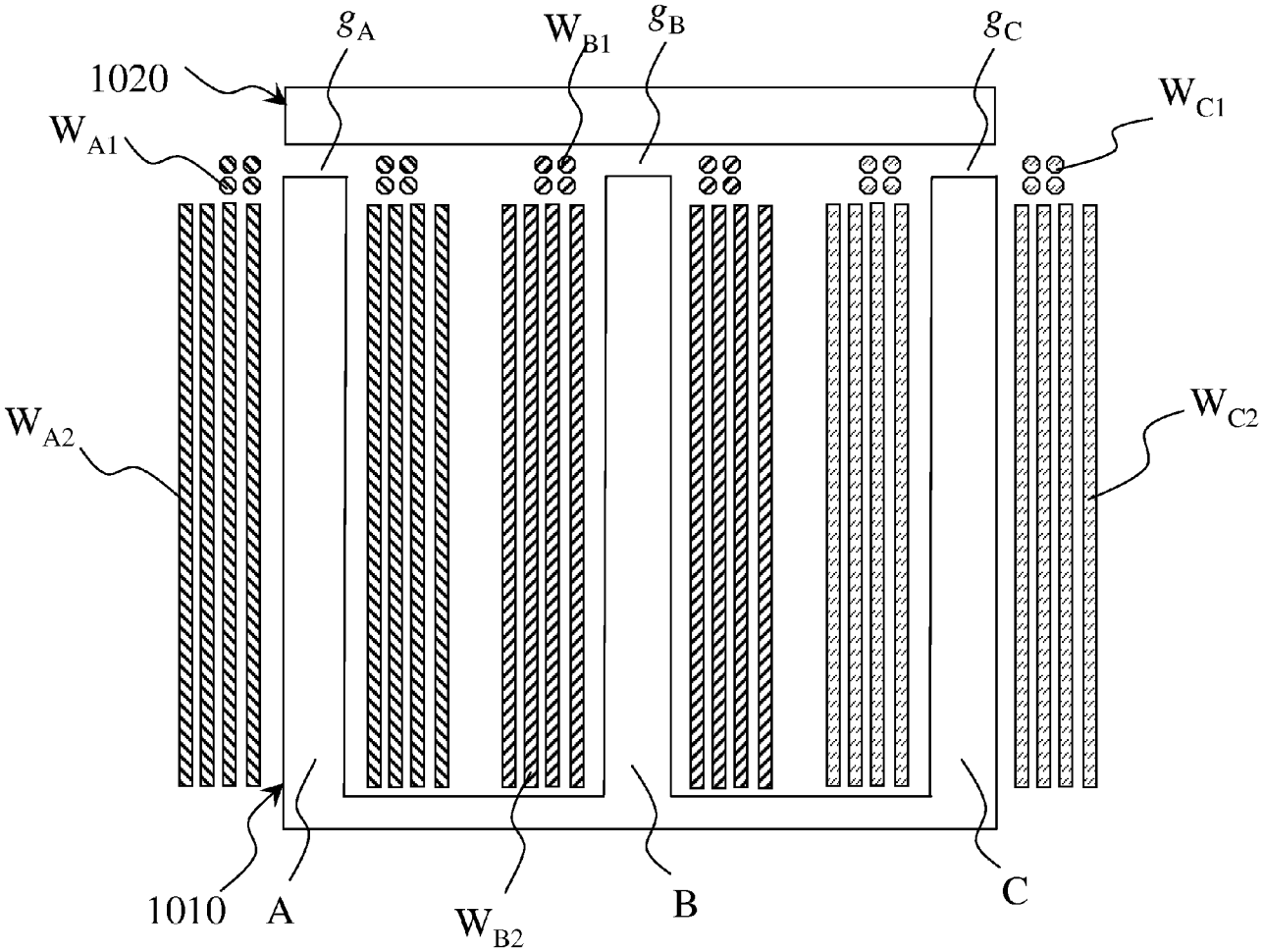
FIG. 10 is an exemplary diagram of a three-phase inductor device, in accordance with an embodiment of the present disclosure.

With reference to FIG. 10, illustrating a three-phase inductor device in accordance with an embodiment of the present disclosure. In this embodiment, the magnetic core is an EI type core and is formed by coupling a substantially E-shaped core 1010 to a magnetic bar 1020. The E-shaped core 1010 has three longitudinal arms A, B, C, and a latitudinal arm. Each longitudinal arms A, B, C has a first end that is extended orthogonally from the latitudinal arm. Second ends of the longitudinal arms A, B, C are disposed adjacent to the latitudinal arm with a corresponding air gap $g_A$, $g_B$, $g_C$. Three first windings $W_{A1}$, $W_{B1}$, $W_{C1}$ are wrapped around the longitudinal arms A, B, C respectively, and three second windings $W_{A2}$, $W_{B2}$, $W_{C2}$ are wrapped around the longitudinal arms A, B, C respectively.

Using the longitudinal arm A as an example, the first winding $W_{A1}$ is connected to the second winding $W_{A2}$ in parallel. The first winding $W_{A1}$ is wrapped around the arm A near the air gap $g_A$, and the second winding $W_{A2}$ is wrapped around the arm A away from the air gap $g_A$, which reduces the magnetic interference. Further, in this embodiment, the first winding has thin wire with smaller diameter such as a thin conducting wire, a multi-stand wire or the Litz wire, for reducing the eddy current loss brought by the air-gap magnetic field strength and the bypassing magnetic field strength. The second winding $W_{A2}$ uses thicker wire with a larger diameter, such as a copper foil winding or a PCB winding, for reducing the DC current loss. However, the coupling relationship and structural concept of the first windings $W_{A1}$, $W_{B1}$, $W_{C1}$ and the second windings $W_{A2}$, $W_{B2}$, $W_{C2}$ are similar to the previous embodiments of FIGS. 4 and 5, thereby omitting the duplicate description.

It is noted that the magnetic core in accordance with embodiments of the present disclosure can be in any magnetic core, which includes magnetic core with/without an air gap, and magnetic core be in any shape.

Figure 11:
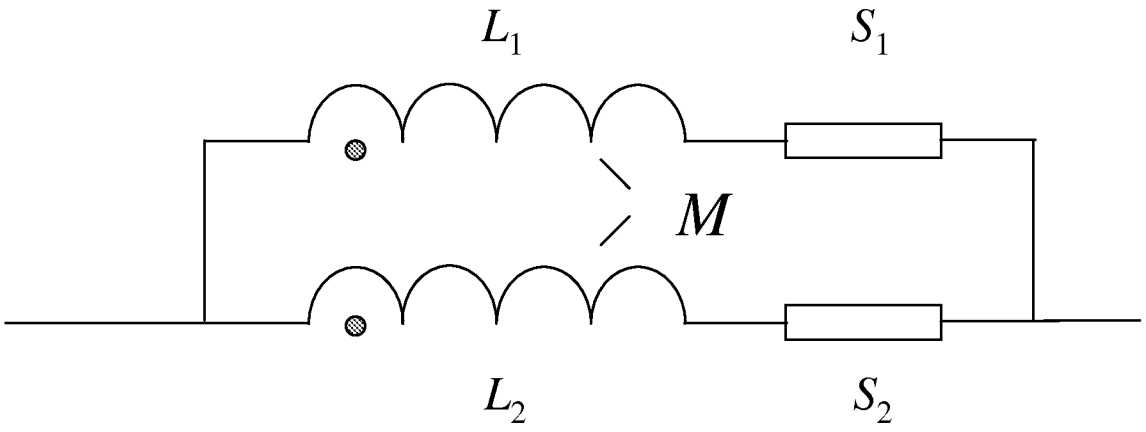
FIG. 11 is a circuit diagram of the inductor device connects to current sensing elements in accordance with an embodiment of the present disclosure.

N&3; For any magnetic core, the embodiments of the present disclosure achieve separating the AC and DC current components of the DC filter inductor device. In order to measure the current of the inductor device, as shown in FIG. 11, the inductor device further includes a first current sensing element $S_1$ and a second current sensing element $S_2$. The first current sensing element $S_1$ is connected to the first winding $L_1$ in series. The second current sensing element $S_2$ is connected to the second winding $L_2$ in series. Accordingly, current through each diverged path of the first and second winding $L_1$, $L_2$ can be properly measured by the first and the second current sensing element $S_1$, $S_2$ respectively. In some embodiments, the current sensing elements $S_1$, $S_2$ may be resistors or Hall-effect sensing devices or other sensing devices.

Figure 12:
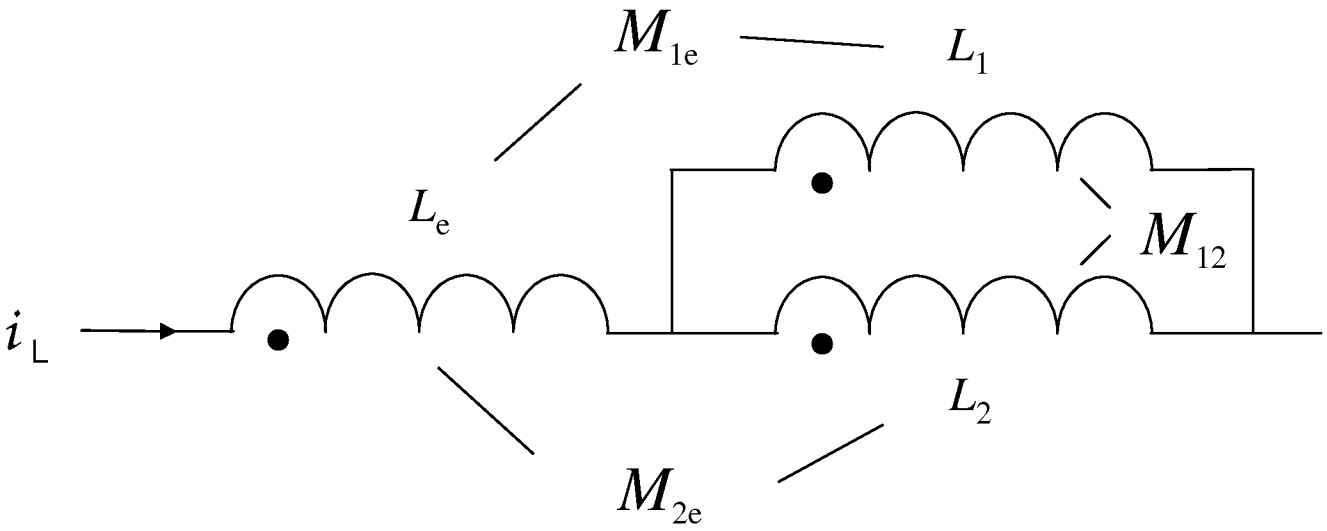
FIG. 12 is a circuit diagram of the inductor device in accordance with an embodiment of the present disclosure.
Figure 13:
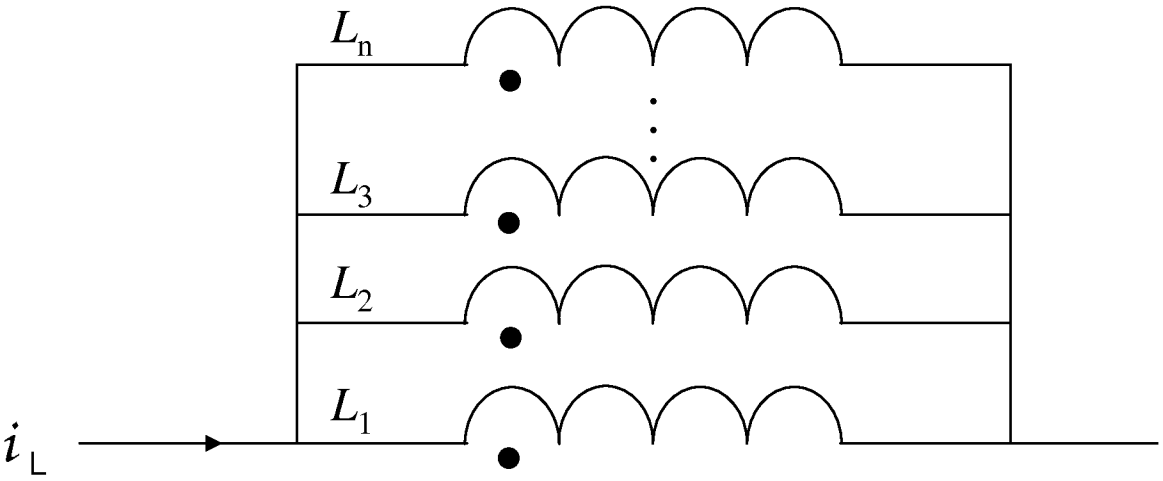
FIG. 13 is a circuit diagram of the inductor device in accordance with an embodiment of the present disclosure.

Further, as shown in FIG. 12, the inductor device further comprises a coupling winding $L_e$. The coupling winding $L_e$ is connected to the windings $L_1$, $L_2$ in series, which provides the mutual inductances $M_{1e}$, $M_{2e}$ based on the embodiment of FIG. 5. The added coupling winding $L_e$ enhances the inductance of the inductor device and remains the separation of AC and DC current components. Moreover, another embodiment of FIG. 13 indicated that the inductor device may further includes multiple windings $L_3$~$L_n$ that connected to each other in parallel.

It is noted that winding the two parallel-connected windings can wrapped around the magnetic core respectively, or winding together to the magnetic core in a parallel configuration.

While the disclosure has been described in connection with a number of embodiments and implementations, the disclosure is not so limited but covers various obvious modifications and equivalent arrangements, which fall within the purview of the appended claims. Although features of the disclosure are expressed in certain combinations among the claims, it is contemplated that these features can be arranged in any combination and order.

What is claimed is:

1. A device for a direct current filter inductor, comprising:

a magnetic core having at least one air gap; and at least one first winding and at least one second winding, which are connected to each other in parallel that having a mutual inductance, and are wrapped around the magnetic core respectively, wherein a difference between a first inductance of the first winding and the mutual inductance is smaller than ⅓ of a difference between a second inductance of the second winding and the mutual inductance;

a Direct Current (DC) resistance of the first winding is larger than a DC resistance of the second winding; and the first winding is closer to the air gap compared to the second winding.

2. The device as claimed in claim 1, wherein the first winding has a wire diameter that is smaller than a wire diameter of the second winding.

3. The device as claimed in claim 1, wherein the first winding and the second winding are wrapped around the magnetic core separately.

4. The device as claimed in claim 1, further comprising an inductance element connected to the first winding and the second winding in parallel or in series.

5. The device as claimed in claim 1, wherein the first winding is fully or partially wrapped around the air gap.

6. The device as claimed in claim 1, wherein the first inductance is equal to the mutual inductance.

7. The device as claimed in claim 1, further comprising an inductance element connected to the first winding in series when the first inductance is smaller than the mutual inductance, wherein the first winding and the inductance element are connected to the second winding in parallel, and a difference between the summation of the first inductance and an inductance of the inductance element and the mutual inductance is smaller than the difference between the second inductance and the mutual inductance.

8. The device as claimed in claim 7, wherein the difference between the summation of the first inductance and the inductance of the inductance element and the mutual inductance is smaller than ⅓ of the difference between the second inductance and the mutual inductance.

9. The device as claimed in claim 7, wherein a DC resistance summation of the first winding and the inductance element is larger than the DC resistance of the second winding.

10. The device as claimed in claim 1, wherein the magnetic core is an EE type core that comprises a middle arm and two side arms, wherein the middle arm has the air gap, the first winding is wrapped around the middle arm, and the second winding is wrapped around the first winding.

11. The device as claimed in claim 1, wherein the magnetic core is an UU type core formed by two oppositely U-shaped core, and each U-shaped core comprises a longitudinal arm;

two latitudinal side arms are extended orthogonally from two ends of the longitudinal arm respectively; wherein the latitudinal side arms of the U-shaped core are abutted adjacent to the corresponding latitudinal side arms of the other U-shaped core, thereby forming the two air gaps in between, and two first windings are wrapped around the corresponding air gaps and two second windings are wrapped around the corresponding longitudinal arms.

12. The device claimed in claim 1, wherein the magnetic core is an EI type core formed by coupling a substantially E-shaped core to a magnetic bar, and the E-shaped core comprises three longitudinal arms and a latitudinal arm, each longitudinal arms has a first end that is extended orthogonally from the latitudinal arm, and second ends of the longitudinal arms are disposed adjacent to the magnetic bar with a corresponding air gap, wherein three first windings are wrapped around the corresponding longitudinal arms, and three second windings are wrapped around the corresponding longitudinal arms.

13. The device as claimed in claim 1, further comprising a first current sensing element connected to the first winding in series, and is configured to sense current flowing through the first winding.

14. The device as claimed in claim 13, further comprising a second current sensing element connected to the second winding in series, and is configured to sense current flowing through the second winding.

15. The device as claimed in claim 1, wherein the first winding has a first wire or a multi-stand wire, and the second winding has a second wire, a copper foil winding or a PCB winding, wherein a wire diameter of the first wire is smaller than a wire diameter of the second wire.

16. A device for a direct current filter inductor, comprising a magnetic core;

at least one first winding having a first end and a second end; and at least one second winding having a first end and a second end, wherein the first end and the second end of the first winding are connected to the first end and the second end of the second winding, respectively; and wherein the first winding and the second winding has a mutual inductance, and a difference between a first inductance of the first winding and the mutual inductance is smaller than ⅓ of a difference between a second inductance of the second winding and the mutual inductance;

a DC resistance of the first winding is larger than a DC resistance of the second winding.

17. The device as claimed in claim 16, wherein the first and the second windings are separately wrapped around the magnetic core or wrapped around the magnetic core together.

18. The device as claimed in claim 16, further comprising an inductance element connected to the first winding and the second winding in parallel or in series.

19. The device as claimed in claim 16, wherein the first inductance is equal to the mutual inductance.

20. The device as claimed in claim 16, further comprising an inductance element connected to the first winding in series when the first inductance is smaller than the mutual inductance, wherein the first winding and the inductance element are connected to the second winding in parallel, and a difference between the summation of the first inductance and an inductance of the inductance element and the mutual inductance is smaller than the difference between the second inductance and the mutual inductance.

21. The device as claimed in claim 20, wherein the difference between the summation of the first inductance and the inductance of the inductance element and the mutual inductance is smaller than ⅓ of the difference between the second inductance and the mutual inductance.

22. The device as claimed in claim 20, wherein a DC resistance summation of the first winding and the inductance element is larger than the DC resistance of the second winding.

23. The device as claimed in claim 16, further comprising a first current sensing element connected to the first winding in series, and is configured to sense current flowing through the first winding.

24. The device as claimed in claim 23, further comprising a second current sensing element connected to the second winding in series, and is configured to sense current flowing through the second winding.

25. The device as claimed in claim 16, wherein the first winding has a first wire or a multi-stand wire, and the second winding has a second wire, a copper foil winding or a PCB winding, wherein a wire diameter of the first wire is smaller than a wire diameter of the second wire.

26. A manufacturing method for a direct current filter inductor, comprises step of:

providing a magnetic core;

wrapping at least one first winding and at least one second winding around the magnetic core, wherein a mutual inductance formed by the first winding and the second winding;

configuring a difference between a first inductance of the first winding and the mutual inductance being smaller than ⅓ of a difference between a second inductance of the second winding and the mutual inductance, and configuring a DC resistance of the first winding being larger than a DC resistance of the second winding; and coupling the first winding to the second first winding in parallel.

27. The manufacturing method as claimed in claim 26, wherein the magnetic core has at least one air gap, and the first winding is closer to the air gap compared to the second winding.

28. The manufacturing method as claimed in claim 27, further comprising step of:

wrapping the first winding is fully or partially around the air gap.

29. The manufacturing method as claimed in claim 26, wherein a first end and a second end of the first winding are connected to a first end and a second end of the second winding, respectively.

30. The manufacturing method as claimed in claim 26, wherein the step of wrapping the first winding and the second winding around the magnetic core, further comprising step of:

wrapping the first winding and the second winding separately or together around the magnetic core.

31. The manufacturing method as claimed in claim 26, further comprising step of:

providing an inductance element connected to the first winding and the second winding in series or in parallel.

32. The manufacturing method as claimed in claim 26, further comprising step of:

configuring the first inductance of the first winding being equal to the mutual inductance.

33. The manufacturing method as claimed in claim 26, further comprising step of:

providing an inductance element connected to the first winding when the first inductance of the first winding is smaller than the mutual inductance, wherein the first winding and the inductance element are connected to the second winding in parallel, and a difference between the summation of the first inductance and an inductance of the inductance element and the mutual inductance is smaller than the difference between the second inductance and the mutual inductance.

34. The manufacturing method as claimed in claim 33, wherein the difference between the summation of the first inductance and the inductance of the inductance element and the mutual inductance is smaller than ⅓ of the difference between the second inductance and the mutual inductance.

35. The manufacturing method as claimed in claim 33, further comprising step of:

configuring a DC resistance summation of the first winding and the inductance element being larger than the DC resistance of the second winding.

36. The manufacturing method as claimed in claim 26, further comprising step of:

providing a first current sensing element connected to the first winding in series.

37. The manufacturing method as claimed in claim 36, further comprising step of:

providing a second current sensing element connected to the second winding in series.

* * * * *